United States Patent [19]

Matechuk

[11] Patent Number: 4,825,597

[45] Date of Patent: May 2, 1989

[54] CORNER HAND SANDER

[76] Inventor: William Matechuk, 314-20 Bradmon Drive, St. Catharines Ontario, Canada, L2M 3S5

[21] Appl. No.: 194,482

[22] Filed: May 13, 1988

[51] Int. Cl.[4] ..... B24D 15/04

[52] U.S. Cl. ..... 51/392; 51/358; 51/205 R; 15/244.2; 15/244.4

[58] Field of Search ..... 51/358, 370, 391, 392, 51/393, 205 R; 15/144 A, 210 R, 210.5, 244.1, 244.2, 244.4

[56] References Cited

U.S. PATENT DOCUMENTS

| | | | |
|---|---|---|---|
| 3,120,084 | 2/1964 | Phillips | 15/244.2 X |
| 3,134,124 | 5/1964 | Horn | 15/244.1 |
| 3,171,152 | 3/1965 | Corcoran | 15/244.2 X |
| 3,279,130 | 10/1966 | Nelson | 51/392 X |
| 3,713,744 | 1/1973 | Sims | 15/210 R X |
| 3,842,549 | 10/1974 | Johnston | 51/392 |
| 4,185,388 | 1/1980 | Jarby | 51/358 X |

*Primary Examiner*—Robert P. Olszewski
*Attorney, Agent, or Firm*—McConnell and Fox

[57] ABSTRACT

A hand sanding tool for sanding corner joints in dry wall construction comprises a resilient foam block shaped to fit the corner and faced with suitable abrasive grit. A carrier is provided for demountably supporting the foam block and properly distributing the force over the faces of the foam block. The carrier is mounted on a handle by a simple universal joint and the handle is arranged to receive an extension piece.

9 Claims, 1 Drawing Sheet

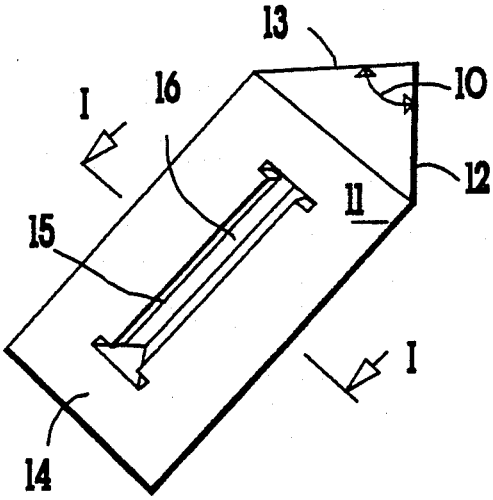
Fig.1A
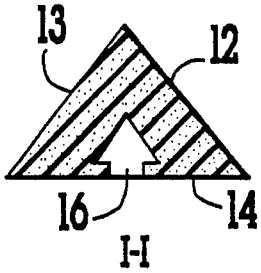
Fig.1B
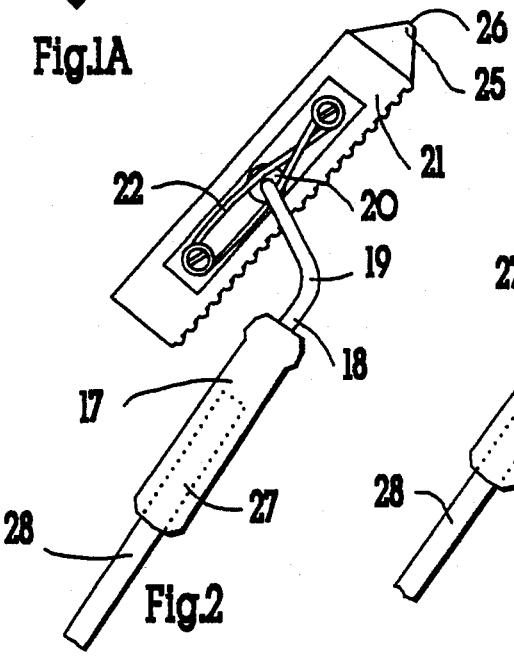
Fig.2
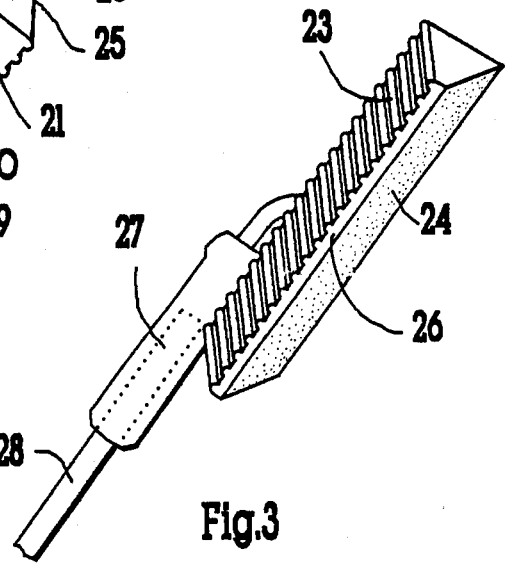
Fig.3
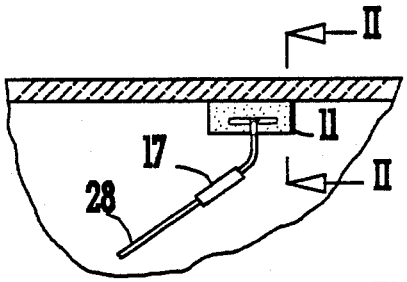
Fig.4
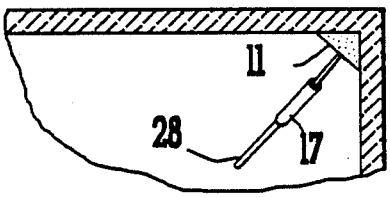
II-II FIG.4A

CORNER HAND SANDER

FIELD OF THE INVENTION

This invention relates to hand sanding tools and in particular to a tool intended for dry wall sanding particularly in corners at the intersection of two surfaces.

DESCRIPTION OF THE PRIOR ART

In dry wall construction, sheets of plaster-filled material are placed on the surface of the wall and the joints between the sheets are filled and taped to obscure the joint as much as possible. In finishing, the joint is sanded to reduce the level of the tape and the compound to the same level as the surface of the sheets. In my previous application No. 103,362, I described a power sander for sanding off the surface of joints. This power sander, however, while suitable for sanding joints between flat surfaces will not reach into corners, for example, the corner at the junction between a wall and ceiling or the corner between the junction of two walls. In the past it has been necessary to hand sand this junction by means of a suitable abrasive material mounted on a sanding block. In the vertical corner between two walls most of the corner can be reached by the workman, but the upper portion of this corner and the corner between a wall and a ceiling is difficult to reach and may require either a ladder or suitable scaffolding to enable the workman to reach the corner and sand it properly. Such a procedure is obviously time-consuming and it is desirable to provide a means for conveniently sanding corners without requiring the user to mount a ladder or scaffold to reach the surface.

SUMMARY OF THE INVENTION

In accordance with the present invention, a tool is provided which sands both surfaces of the corner at the same time and may be used to reach a ceiling/wall corner while the workman is standing on the floor. The tool also is arranged to permit rapid and convenient replacement of the abrasive surfaces used for sanding and to properly distribute the forces over the surface being sanded to ensure a uniform, smooth abrading of the surface and thus ensure a minimal difference between the joint and the adjacent surfaces.

A clearer understanding of my invention may be had from a consideration of the drawings.

BRIEF DESCRIPTION OF THE DRAWINGS

FIG. 1A is a perspective view of a resilient abrasive block in accordance with the invention.

FIG. 1B is a section of the block of FIG. 1A at section I—I.

FIG. 2 is a perspective view of the abrasive block holder viewed from the handle side.

FIG. 3 is the abrasive block holder viewed from the opposite side from that, shown in FIG. 2.

FIGS. 4 and 4A are illustrations of the tool in use.

DESCRIPTION OF THE PREFERRED EMBODIMENT

As seen in FIG. 1, the abrasive surface used for sanding consists of a block of closed cell urethene foam as manufactured by Ontario Rubber under the designation D1066. Other similar foams would be satisfactory so long as the foam is a closed cell foam and has resilience and texture similar to D1066. The foam is in the form of prism, the apex of the prism having an angle of 90°. The cross-section of the foam body 11 is, as shown at FIG. 1B, an isosceles triangle, the sides of the triangle being between three and four inches and its hypotenuse between four and five inches. The surfaces 12 and 13 are coated with a suitable abrasive material, such as garnet grit, which is stuck onto the surface of the urethene by means of a suitable adhesive, such as that supplied by Pierce & Stevens Canada Ltd., in a manner well known in the art. The rear surface 14 of the body 11 has an elongated aperture 15 having a cross-section as shown in FIG. 1B of the form of a truncated triangle having a slot 15 at its base. The abrasive block 11 is mounted on the holder which is shown in FIG. 2. The holder consists of a suitable handle 17 including a metallic rod 18 with a bend 19 near its center. The end of the rod 18 is terminated in a ball 20. The abrasive block carrier 21 is mounted on ball 20 by means of a spring-retaining clip 22 in such a manner as to permit the carrier 21 to rotate freely with respect to the handle 17 on ball 20.

As is more clearly shown in FIG. 3, the faces 23 and 24 of the carrier 21 are provided with surfaces which increase their coefficient of friction. Surface 23 is shown with a series of ribs while surface 24 is shown with a coating of abrasive material. It will be understood that normally both surfaces 23 and 24 are treated in the same way and the use of two different materials or treatments of surfaces 23 and 24 is for illustrative purposes only and both surfaces could either be provided with ribs or with an abrasive coating, but normally both surfaces 23 and 24 would be coated or treated in the same manner.

It will be seen that the cross-section of carrier 21 is also of substantially triangular form and is a truncated isosceles triangle but the angle at the apex 25 is considerably less than 90° and should be between 50° and 60°. As indicated with respect to the aperture in the block 11, the cross-section of the carrier, while of essentially triangular form, is truncated to produce a flat surface 26 at the location which would otherwise be the apex of the triangle. The surface 26, in a tool having dimension substantially as previously described, would have a width of about one quarter of an inch and the equal sides of the triangle, that is sides 23 and 24, would have a width of approximately one and a quarter inches. The length of the carrier will depend upon the size of the block to be mounted and in the case where the overall length of block 11 is in the neighborhood of seven inches, the carrier would have a length of about five and a half inches and the aperture 15 in the back of the block would have a length of five and a half inches and a width of approximately half an inch. All the dimensions given are preferred dimensions but it will be understood that variations may be made depending on the particular location of use of the tool and the materials used. However, those described have been found to be very satisfactory in producing the proper distribution of force over the face of the abrasive material. As noted, the angle of the cross-section of the carrier is less than 90° resulting in the concentration of force towards the apex of the abrasive block. It is desirable that this distribution of force be maintained so that a suitable feathering of the edge of the joint results from the reduced pressure from the apex of the block to its rear corners.

It will be evident to those familiar with the art that the joint itself has the greatest amount of filler material and the maximum abrading must occur at the apex of the abrasive block. The outer corners of the abrasive block will be running over the surface of the intersecting sheets of dry wall material and minimal abrasion is required in this area. Distribution of forces produced by the shaping of the abrasive block and its carrier must result in a gradual change of pressure from its apex to its outer corners thus producing a suitable feathering.

As will be seen, the end of the handle 17 is provided with a threaded aperture 27 which is arranged to accept a standard extension pole 28 commonly used by painters for remote operation of paint rollers. These standard handles are usually four feet long and, by installing the extension 28 in the handle 17, the tool may be used to reach the corner junction between a ceiling and wall without requiring the user to ascend a ladder or scaffolding.

As shown in FIGS. 4 and 4A, the extension 28 will normally be held at an angle with respect to the wall and to the ceiling. The bend in rod 18 is provided to ensure that the forces caused by the friction of the sanding block are not transverse to the handle or extension but are primarily longitudinal. It is obvious that forces transverse to the end of the extension will cause greater bending of the extension than will forces longitudinal to the extension. It is therefore desirable that the forces from the block be, as far as possible, in a longitudinal direction to minimize vibration and bending of the handle. In use, the pressure applied by the user to the sanding block will be in a transverse direction causing bending of the handle, but this force is relatively constant. On the other hand, the forces produced by the frictional engagement of the abrasive block with the surface may vary depending upon the condition of the surface and the number of projections, etc. It is therefore desirable that, in the presence of these variable forces, vibrations are not set up in the handle and so the extension and the handle are connected to the block by means of the rod 18 which is bent thus encouraging the user to hold the extension at a direction other than right angles to the carrier. Variations of the frictional engagement of the abrasive block with the joint will therefore produce forces applied primarily longitudinally down the handle and not cause vibration of the abrasive block. Vibrations of the block will evidently result in non-uniform sanding and undesirable appearance of the joint.

As has previously been indicated, the particular dimensions suggested are only preferred, many variations can be made within the scope of the invention both as to the dimension of the abrasive block, the carrier, the handle and other elements all within the scope of the invention.

I claim:

1. A hand sanding tool for sanding corners of dry wall construction comprising;

(a) a resilient foam block of prismatic form having a cross-section of the form of a right angled isosceles triangle and having its surfaces defined by the equal sides of the triangle coated with abrasive material;

(b) a carrier of solid material of prismatic form having a cross-section substantially of the form of an isosceles triangle;

(c) a handle pivotally mounted on said carrier;

(d) an aperture in said resilient foam block with its opening in the surface of said foam block defined by the hypotenuse of said right angled triangle, said aperture shaped to snugly receive said carrier.

2. A hand sanding tool as claimed in claim 1 wherein said carrier cross-section is a truncated isosceles triangle.

3. A hand sanding tool as claimed in claim 1 wherein said handle is mounted by a ball joint onto the surface of said carrier defined by the base of the said isosceles triangle.

4. A hand sanding tool as claimed in claim 1 wherein the surfaces of said carrier defined by the equal sides of said isosceles triangle are treated to increase their coefficient of friction.

5. A hand sanding tool as claimed in claim 1 wherein said handle is arranged to accept an extension member.

6. A hand sanding tool for sanding the corner joints of dry wall construction comprising;

(a) a block of resilient foam plastic of prismatic form with a cross-section equal to a right angled isosceles triangle with the length of said prism about twice the length of the equal sides of the isosceles triangle and the surfaces of said block defined by said equal sides and said length being coated with abrasive grit;

(b) a carrier comprising a solid prismatic body smaller than said block of foam plastic and snugly fitting into an aperture in the said block of foam plastic through a hole in the surface defined by the hypotenuse of said right angled triangle and frictionally engaging the inner surfaces of said aperture whereby said block of foam plastic is firmly retained on said carrier but may be conveniently removed and replaced;

(c) a handle connected to the surface of said carrier defined by the base of said isosceles triangle by means of a universal joint.

7. A hand sanding tool as claimed in claim 6 wherein said handle includes an extension in the form of a metal rod terminated in a ball which is retained in said carrier by a spring clip.

8. A hand sanding tool as claimed in claim 7 wherein said metal rod is bent to an obtuse angle at a point near its center.

9. A hand sanding tool as claimed in claim 8 wherein said handle includes means for connecting an extension to said handle to permit use of said tool in locations not otherwise conveniently reached by the user.

* * * * *